US007607408B2

(12) United States Patent
Peart

(10) Patent No.: US 7,607,408 B2
(45) Date of Patent: Oct. 27, 2009

(54) WATER HEATER BURNER CLOGGING DETECTION AND SHUTDOWN SYSTEM

(75) Inventor: Jacob A. Peart, Wetumpka, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 0 days.

(21) Appl. No.: 11/535,775

(22) Filed: Sep. 27, 2006

(65) Prior Publication Data

US 2007/0113799 A1 May 24, 2007

Related U.S. Application Data

(63) Continuation of application No. 10/991,804, filed on Nov. 18, 2004, now Pat. No. 7,162,980.

(51) Int. Cl.
*F23Q 9/00* (2006.01)
*F24H 9/14* (2006.01)

(52) U.S. Cl. ..... 122/14.21; 122/14.1; 122/14.31; 431/278

(58) Field of Classification Search ..... 431/6, 431/22, 278, 281; 122/14.1, 14.2, 14.21, 122/14.31, 17.1
See application file for complete search history.

(56) References Cited

U.S. PATENT DOCUMENTS

| | | | | |
|---|---|---|---|---|
| 1,302,914 | A | | 5/1919 | Goreau |
| 2,112,655 | A | | 3/1938 | Morrow |
| 2,885,150 | A | | 5/1959 | Douglas |
| 3,122,195 | A | | 2/1964 | Kimmel et al. |
| 3,561,896 | A | | 2/1971 | Riehl |
| 3,622,257 | A | | 11/1971 | Hein et al. |
| 3,692,016 | A | | 9/1972 | Stikkers et al. |
| 3,834,856 | A | | 9/1974 | James |
| 3,992,137 | A | | 11/1976 | Streisel |
| 4,059,386 | A | | 11/1977 | Eising |
| 4,125,356 | A | | 11/1978 | Ohashi et al. |
| 4,413,976 | A | * | 11/1983 | Scherer ..... 431/278 |
| 4,597,733 | A | | 7/1986 | Dean et al. |
| 4,613,300 | A | | 9/1986 | Simpson |
| 4,919,084 | A | | 4/1990 | Maurice |

(Continued)

FOREIGN PATENT DOCUMENTS

| | | |
|---|---|---|
| JP | 7035341 | 2/1995 |
| JP | 9196361 | 7/1997 |
| JP | 2002106838 | 4/2002 |
| JP | 2002106838 A | 4/2002 |
| JP | 2002106838 | 10/2002 |

OTHER PUBLICATIONS

May 26, 2005 New Zealand Examination Report.

(Continued)

*Primary Examiner*—Gregory A Wilson
(74) *Attorney, Agent, or Firm*—Haynes and Boone, LLP

(57) ABSTRACT

A fuel-fired water heater has main and pilot burners disposed in its combustion chamber. Illustratively, all of the primary combustion air utilized by the main and pilot burners during firing thereof is supplied thereto via an enclosed path extending to the burners from outside of the combustion chamber. A burner clogging detection system is operative to shut down further combustion, upon sensing a condition of the pilot burner flame indicative of a predetermined degree of pilot burner clogging, prior to the main burner being clogged to an unacceptable degree by particulate matter entrained in incoming combustion air being delivered to the main burner.

6 Claims, 1 Drawing Sheet

U.S. PATENT DOCUMENTS

| | | | | |
|---|---|---|---|---|
| 4,976,609 | A | 12/1990 | Grob et al. | |
| 5,165,887 | A | 11/1992 | Ahmady | |
| 5,197,665 | A | 3/1993 | Jenson et al. | |
| 5,240,411 | A | 8/1993 | Abalos | |
| 5,318,436 | A | 6/1994 | Colket, III et al. | |
| 5,520,536 | A | 5/1996 | Rodgers et al. | |
| 5,554,021 | A | 9/1996 | Robertson et al. | |
| 5,575,273 | A | 11/1996 | Moore, Jr. | |
| 5,630,517 | A | 5/1997 | Maznik | |
| 5,797,355 | A | 8/1998 | Bourke et al. | |
| 5,979,673 | A | 11/1999 | Dooley | |
| 6,031,209 | A | 2/2000 | Wiesman | |
| 6,085,699 | A | 7/2000 | Valcic et al. | |
| 6,113,384 | A | 9/2000 | Sebastiani | |
| 6,139,311 | A | 10/2000 | Bowman et al. | |
| 6,295,951 | B1 | 10/2001 | Valcic et al. | |
| 6,340,298 | B1 | 1/2002 | Vandrak et al. | |
| 6,497,200 | B2 | 12/2002 | Stretch et al. | |
| 6,508,056 | B1 | 1/2003 | Brandon | |
| 6,520,771 | B1 | 2/2003 | Berry | |
| 6,540,504 | B2 | 4/2003 | Kobayashi et al. | |
| 6,546,897 | B1 | 4/2003 | Edds et al. | |
| 6,554,608 | B1 | 4/2003 | Bowman et al. | |
| 6,561,138 | B2 * | 5/2003 | Kobayashi et al. | 122/14.2 |
| 6,648,627 | B2 * | 11/2003 | Dane | 431/22 |
| 6,743,010 | B2 | 6/2004 | Bridgeman et al. | |
| 6,761,134 | B1 | 7/2004 | Trant | |
| 6,814,031 | B2 | 11/2004 | Stretch et al. | |
| 7,028,642 | B2 | 4/2006 | Peart | |
| 7,051,530 | B2 * | 5/2006 | Blomeyer | 60/737 |
| 7,261,061 | B2 * | 8/2007 | Shellenberger et al. | 122/14.2 |
| 2001/0029905 | A1 | 10/2001 | Kobayashi et al. | |
| 2002/0152971 | A1 | 10/2002 | Kobayashi et al. | |
| 2003/0183177 | A1 | 10/2003 | Kobayashi et al. | |
| 2003/0188699 | A1 | 10/2003 | Valcic et al. | |
| 2005/0092262 | A1 | 5/2005 | Lesage | |
| 2006/0105281 | A1 | 5/2006 | Peart | |
| 2006/0118063 | A1 * | 6/2006 | Shellenberger et al. | 122/14.2 |

OTHER PUBLICATIONS

United States Patent and Trademark Office, Office Action mailed May 28, 2008, U.S. Appl. No. 11/534,720, 12 pages, Alexandria, Virginia.

United States Patent and Trademark Office, Office Action mailed Oct. 1, 2008, U.S. Appl. No. 11/534,720, 11 pages, Alexandria, Virginia.

United States Patent and Trademark Office, Advisory Action Before the Filing of an Appeal Brief mailed Oct. 28, 2008, U.S. Appl. No. 11/534,720, 3 pages, Alexandria, Virginia.

United States Patent and Trademark Office, Office Action mailed Feb. 10, 2009, U.S. Appl. No. 11/534,720, 10 pages, Alexandria, Virginia.

* cited by examiner

WATER HEATER BURNER CLOGGING DETECTION AND SHUTDOWN SYSTEM

CROSS-REFERENCE TO RELATED APPLICATION

This application is a continuation of U.S. application Ser. No. 10/991,804, filed on Nov. 18, 2004, now U.S. Pat. No. 7,162,980 such application being hereby incorporated herein in its entirety by reference.

BACKGROUND OF THE INVENTION

The present invention generally relates to fuel-fired heating apparatus and, in a representatively illustrated embodiment thereof, more particularly provides a fuel-fired water heater having incorporated therein a burner clogging detection and shutdown system.

Fuel-fired water heaters typically operate in locations (such as, for example, attics, closets, basements, sheds, etc.) which are not regularly cleaned, and have ambient air containing particulate matter such as lint, dirt and/or oil. It is this contaminant-laden air which is delivered to the water heater as combustion air for its burner system. The airborne particulate matter in such combustion air can, over time, clog the water heater's burner and undesirably increase its production of carbon monoxide.

In view of this it would be desirable to provide a fuel-fired water heater with a burner clogging detection system which could monitor the degree of burner clogging caused by airborne particulate matter ingested by the burner and prevent further burner combustion in response to the detection of a predetermined level of burner clogging. It is to this goal that the present invention is primarily directed.

SUMMARY OF THE INVENTION

In carrying out principles of the present invention, in accordance with a representatively illustrated embodiment thereof, fuel-fired heating apparatus is provided which has a combustion chamber in which a first fuel burner is disposed, the first fuel burner being operative to create a flame in the combustion chamber and being cloggable by particulate matter entrained in primary combustion air delivered thereto during firing thereof. A second fuel burner is operative to create a flame and is also cloggable by particulate matter entrained in primary combustion air delivered thereto during firing thereof.

The representatively illustrated fuel-fired heating apparatus also has an air supply system for supplying primary combustion air from outside the combustion chamber to the first and second fuel burners without exposing the supplied primary combustion air to the interior of the combustion chamber on its way to the first and second fuel burners.

A shutdown system is also incorporated into the fuel-fired heating apparatus for monitoring the condition of the second fuel burner flame and terminating combustion within the combustion chamber when the second burner flame condition is indicative of a predetermined degree of clogging of the second fuel burner. Since all of the primary combustion air supplied to the first and second burners comes from outside the combustion chamber via a path isolated from the interior of the combustion chamber, the degree of particulate matter clogging of the second burner, representatively a pilot burner located within the combustion chamber and operative to ignite the first or main burner, is directly indicative of the degree of particulate matter clogging of the main burner, representatively a radiant fuel burner.

Illustratively, the fuel-fired heating apparatus is a gas-fired water heater provided with a fuel supply system for delivering fuel, from a source thereof, to the main and pilot burners, the fuel supply system including a fuel supply valve, and the shutdown system is operative to cause closure of the fuel valve in response to detecting the change in condition in the pilot burner flame. The shutdown system preferably includes a thermocouple positioned to be impinged upon by the pilot burner flame and operatively coupled to the fuel valve. Other methods of terminating water heater combustion, such as terminating combustion air flow to the burners, could alternatively be employed if desired.

In an illustrated specific structural embodiment thereof, the fuel-fired water heater has a radiant main burner disposed in its combustion chamber and having a hollow body with a perforate flame-holding outer wall section cloggable by particulate matter entrained in combustion air being delivered to the main burner during firing thereof. An air-receiving plenum is coupled to the hollow body and has an interior communicating with the interior of the hollow body, and a wall structure defining a passage for flowing primary combustion air into the plenum, from outside of the combustion chamber, for delivery from within the plenum to the interior of the hollow body.

A pilot fuel burner is disposed in the combustion chamber externally of the main fuel burner and is operative to generate a pilot flame useable to ignite the main fuel burner. The pilot burner has an air inlet portion extending into the plenum and having an air inlet opening disposed within the plenum for receiving combustion air delivered thereto via the aforementioned passage, and a cloggable perforate structure, representatively of a metal wire mesh construction, interposed in the path of combustion air being received by the inlet opening.

The shutdown system operates to terminate combustion in the combustion chamber prior to the outer wall section of the main fuel burner becoming clogged to a predetermined degree, the shutdown system being operative to monitor the condition of the pilot fuel burner flame and terminate combustion within the combustion chamber when the condition becomes indicative of a predetermined degree of clogging of the cloggable perforate structure of the pilot fuel burner.

From a broad perspective, the invention provides a method of operating a fuel-fired heating appliance having a first fuel burner disposed within a combustion chamber, the method comprising the steps of providing a second fuel burner; supplying to the first and second fuel burners all of the primary combustion air utilized thereby during firing thereof from outside the combustion chamber in a manner isolating the supplied primary combustion air from exposure to the interior of the combustion chamber; detecting clogging of the second fuel burner caused by particulate matter entrained in primary combustion air being supplied thereto; and preventing further combustion within the combustion chamber in response to detecting a predetermined degree of clogging of the second fuel burner.

DETAILED DESCRIPTION

Figures 1, 2:
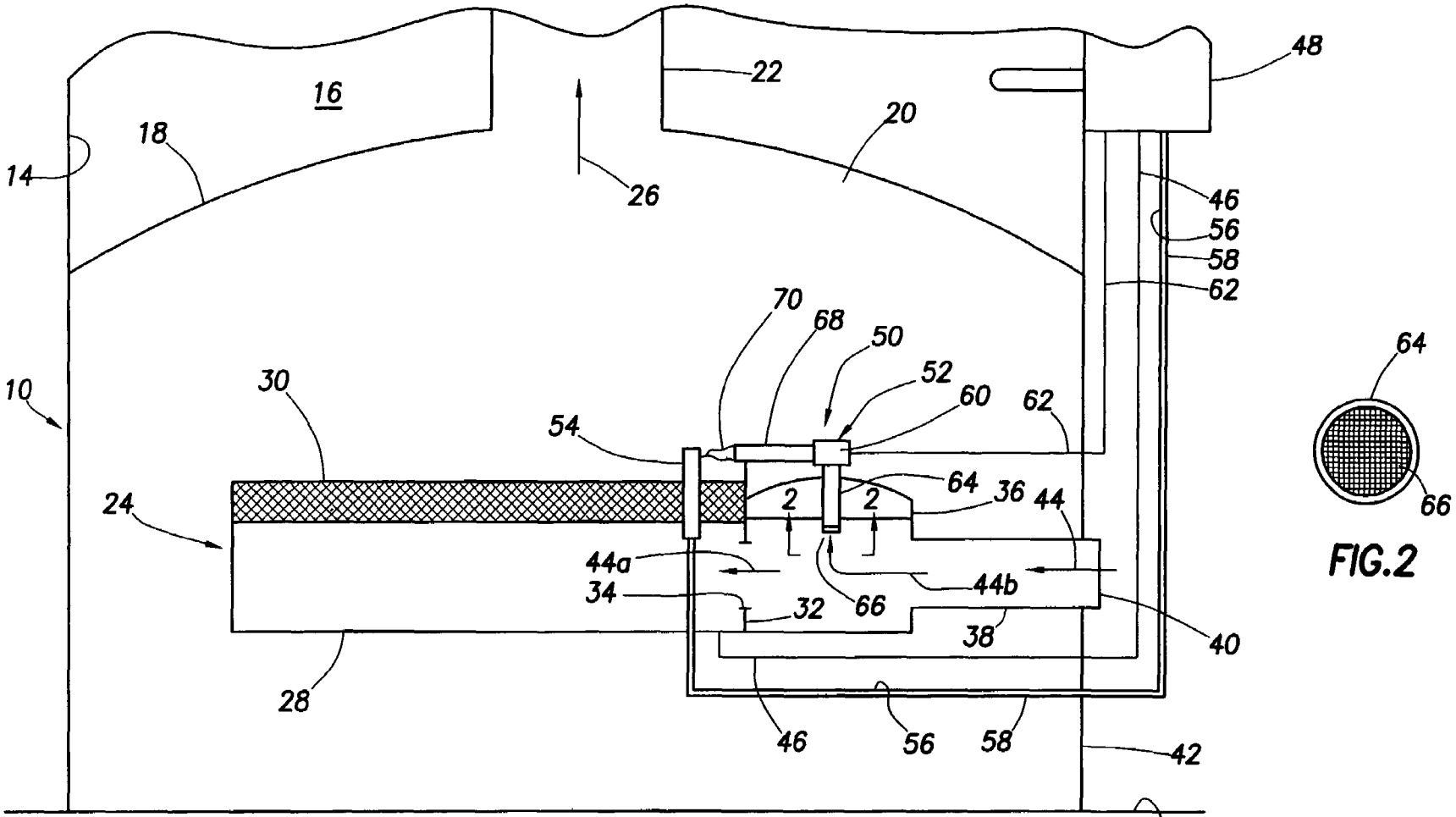
FIG. 1 is a schematic cross-sectional view through a lower end portion of a representative fuel-fired hot water heater incorporating therein a specially designed burner clogging detection and shutdown system embodying principles of the present invention.
FIG. 2 is an enlarged scale bottom end view of an air supply tube portion of a sensor/pilot structure of the system taken along line 2-2 of FIG. 1.

Schematically illustrated in FIG. 1 in cross-sectional form is a lower end portion of a fuel-fired heating appliance, representatively a gas-fired water heater 10, embodying principles of the present invention. While the heating appliance is representatively a water heater, it could alternatively be a different type of fuel-fired heating appliance, such as, for example, a fuel-fired boiler or air heating furnace without departing from principles of the present invention.

Water heater 10 is shown resting on a horizontal support surface such as floor 12 and includes a cylindrical, vertically extending insulated metal tank 14 in which a quantity of pressurized heated water 16 is stored for on-demand delivery in the usual manner to plumbing fixtures (not shown) such as sinks, showers, dishwashers and the like. The bottom wall of the tank 14 defines the top wall 18 of a combustion chamber 20 that underlies the tank 14. Extending upwardly from the wall 18, through the water 16, is a flue pipe 22 communicating with the interior of the combustion chamber 20.

A main gas burner 24, representatively a radiant burner, is disposed within the interior of the combustion chamber 20. Other types of fuel burners could alternatively be utilized without departing from principles of the present invention. Firing of the burner 24 creates hot combustion products 26 that pass upwardly through the flue pipe 22 and transfer combustion heat to the stored water 16.

Radiant burner 24 has a horizontally elongated hollow body 28 with a top perforate flame-holding wall section 30 which is illustratively of a metal wire mesh construction. A right end wall 32 of the burner body 28 has an air inlet opening 34 therein which communicates the interior of the burner body 28 with the interior of an air inlet plenum box 36 projecting horizontally outwardly from the right end wall 32 of the burner body 28. A primary combustion air inlet duct 38, having an open right or inlet end 40, communicates with the interior of the inlet plenum box 36 and extends outwardly through the vertical outer side wall 42 of the combustion chamber 20.

As subsequently described herein, during firing of the burner 24, primary combustion air 44 is delivered to the burner 24 via duct 38 and the plenum 36, and is mixed with fuel gas delivered to the burner 24 through a main burner fuel line 46 interconnected between the burner 24 and a conventional thermostatic gas supply valve 48 externally mounted on the water heater 10 as shown and monitoring the temperature of the stored heated water 16. Burning of the fuel/air mixture by the burner 24 during firing thereof creates within the combustion chamber 20 the aforementioned hot combustion products 26.

Over time, the mesh wall section 30 of the main fuel burner 24 may begin to become clogged with particulate matter (such as lint, dirt and/or oil) entrained in the incoming primary combustion air 44. This can undesirably increase the level of carbon monoxide generated by the firing of the water heater 10. In order to prevent the water heater 10 from being fired after the burner 24 has become clogged to an undesirable degree, the present invention provides a specially designed burner clogging detection and shutdown system 50 which will now be described.

System 50 includes a pilot fuel burner 52 used as a main burner clogging detector, and a thermocouple 54 interconnected to the gas valve 48 by electrical leads 56 and 58. Pilot burner 52 is representatively disposed within the combustion chamber 20 externally of the main burner 24, but could alternatively be positioned outside of the combustion chamber.

The pilot fuel burner 52 is used to selectively ignite the main fuel burner 24 and has a body 60 to which are connected a pilot burner fuel line 62 coupled to the gas supply valve 48, an air inlet tube 64 projecting downwardly into the plenum box 36 and having an open bottom inlet end covered by a perforate cloggable member 66 representatively of a metal wire screen construction (see FIG. 2), and an air/fuel mixture tube 68 having an open outer or left end at which a pilot flame 70 is created during firing of the pilot burner 52. As illustrated in FIG. 1, the thermocouple 54 is positioned to be impinged upon, and be heated by, the pilot flame 70.

During firing of the water heater 10, primary combustion air 44 is drawn into the open end 40 of the air inlet duct 38 and into the main burner inlet plenum box 36. A first portion 44*a* of this incoming primary combustion air 44 enters the hollow main burner body 28 via its end opening 34 and is used to support main burner combustion. At the same time, a second portion 44*b* of the incoming primary combustion air 44 flows upwardly through the screen 66 and into the pilot burner body 60 via the air inlet tube 64 to support pilot burner combustion resulting in the illustrated pilot flame 70.

If the incoming primary combustion air 44 from outside the combustion chamber 20 (which serves both the main burner 24 and the pilot burner 52) contains particulate material (such as lint, dirt, and/or oil) which can clog the screen portion 30 of the main burner 24, such particulate material will (after time) clog the screen 66 on the inlet end of the pilot air intake tube 64. This progressive clogging of the inlet screen 66 changes the pattern of the pilot flame 70 (which also serves as a sensor flame) in a manner such that the pilot flame heat received by the thermocouple 54 is reduced. When this thermocouple-received heat reduction is sufficiently large, the electrical output of the thermocouple 54 (via the electrical leads 56,58) becomes too small to hold its associated gas valve 48 open, and the gas valve 48 returns to its normally closed position, thereby terminating fuel gas flow to both the main and pilot burners 24,52 and stopping further combustion in the combustion chamber. Instead of using the reduced thermocouple electrical output to terminate fuel flow to the burners 24 and 52, it could be used in another manner to terminate combustion in the combustion chamber 20 such as, for example, preventing further primary combustion air flow to the burners.

As can be seen, because all of the primary combustion air supplied to the main and pilot burners 24,52 comes from outside of the combustion chamber 20 via a flow path which is isolated from contact with the interior of the combustion chamber 20, the particulate matter clogging of the pilot burner air inlet screen 66, which alters the pilot flame condition and triggers combustion shutdown, is directly indicative of clogging of the main burner 24. Accordingly, by setting the thermocouple 54 to cause gas valve closure in response to the detection of a predetermined degree of clogging of the pilot burner air inlet screen 66, operation of the water heater 10 may be shut down prior to the main burner 24 becoming clogged with airborne particulate matter to a degree creating an unacceptably high level of carbon monoxide during firing of the water heater 10.

The foregoing detailed description is to be clearly understood as being given by way of illustration and example only, the spirit and scope of the present invention being limited solely by the appended claims.

What is claimed is:

1. Fuel-fired heating apparatus comprising:

a combustion chamber;

a first fuel burner structure disposed in said combustion chamber, said first fuel burner structure including a hollow body with an interior communicating with the interior of an air inlet plenum box projecting outwardly from said hollow body, said air inlet plenum box being disposed entirely within said combustion chamber and, during firing of said first fuel burner structure, receiving unpressurized combustion air from a source thereof;

a second fuel burner structure disposed in said combustion chamber, said second fuel burner structure having a combustion air inlet tube sequentially extending outwardly therefrom, through the interior of said combustion chamber, and then into the interior of said air inlet plenum box, said combustion air inlet tube having an open inlet end disposed within the interior of said air inlet plenum box and covered with a perforate cloggable structure, said first and second fuel burner structures being cloggable by particulate matter in combustion air being delivered thereto during firing thereof, and a shutdown system operative to limit the maximum amount of clogging of said first fuel burner structure by sensing the attainment of a predetermined degree of clogging of said second fuel burner structure and responsively disabling further operation of said first fuel burner structure.

2. The fuel-fired heating apparatus of claim 1 wherein:

said fuel-fired heating apparatus is a water heater.

3. The fuel-fired heating apparatus of claim 1 wherein:

said first fuel burner structure includes a radiant fuel burner with a cloggable perforate flame-holding outer wall section.

4. The fuel-fired heating apparatus of claim 1 wherein:

said second fuel burner structure includes a pilot burner operative to ignite said first fuel burner structure.

5. The fuel-fired heating apparatus of claim 1 wherein:

said fuel-fired heating apparatus further comprises a fuel supply system for delivering fuel, from a source thereof to said first and second fuel burner structures, said fuel supply system including a fuel valve, and said shutdown system is operative to close said fuel valve in response to sensing said predetermined degree of clogging of said second fuel burner structure.

6. The fuel-fired heating apparatus of claim 5 wherein:

said second fuel burner structure is operative to generate a flame during firing thereof, and said shutdown system includes a thermocouple positioned to be impinged upon by said second fuel burner structure flame and operatively coupled to said fuel valve.

* * * * *